US008460396B1

(12) United States Patent
Meyerhoeffer, Jr. et al.

(10) Patent No.: US 8,460,396 B1
(45) **Date of Patent: *Jun. 11, 2013**

(54) SYSTEMS, DEVICES, AND/OR METHODS FOR WASHING AND DRYING A PRODUCT

(75) Inventors: Cecil E. Meyerhoeffer, Jr., Mt. Crawford, VA (US); Aaron L. Showalter, Linville, VA (US)

(73) Assignee: Eastern Bioplastics, LLC, Mt. Crawford, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/460,050

(22) Filed: Apr. 30, 2012

Related U.S. Application Data

(63) Continuation of application No. 13/022,763, filed on Feb. 8, 2011, now Pat. No. 8,182,551.

(51) Int. Cl.
*D06L 1/04* (2006.01)

(52) U.S. Cl.
USPC ..... 8/142; 8/147; 8/149.1; 8/149.3; 8/158

(58) Field of Classification Search
USPC ..... 8/142, 147, 149.1, 149.3, 158
See application file for complete search history.

(56) References Cited

U.S. PATENT DOCUMENTS 8,182,551 B1 * 5/2012 Meyerhoeffer et al. ..... 8/142
2003/0182731 A1 * 10/2003 Worm et al. ..... 8/137

* cited by examiner

*Primary Examiner* — Eisa Elhilo
(74) *Attorney, Agent, or Firm* — Michael Haynes PLC; Michael N. Haynes

(57) ABSTRACT

Certain exemplary embodiments can provide a system, machine, and/or device adapted for washing and drying a product via a continuous forward flow of product and a reverse flow of aqueous content. Certain exemplary embodiments can provide an auger, a rotating paddle wheel, a spiral drum, a cylindrical drum, and/or a ram press.

20 Claims, 10 Drawing Sheets

SYSTEMS, DEVICES, AND/OR METHODS FOR WASHING AND DRYING A PRODUCT

This application is a CON of U.S. patent application Ser. No. 13/022,763 filed on Feb. 8, 2011. Now a U.S. Pat. No. 8,182,551 B1

BRIEF DESCRIPTION OF THE DRAWINGS

A wide variety of potential practical and useful embodiments will be more readily understood through the following detailed description of certain exemplary embodiments, with reference to the accompanying exemplary drawings in which.

Figure 15:
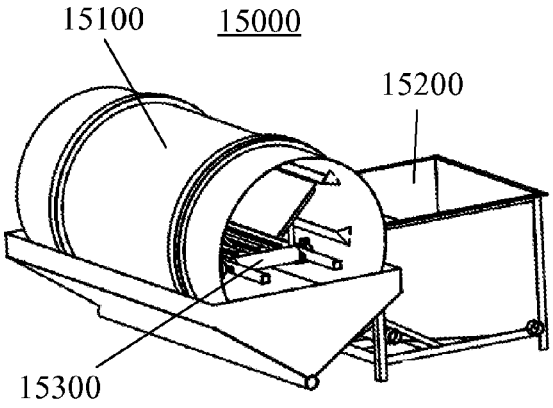
Figure 16:
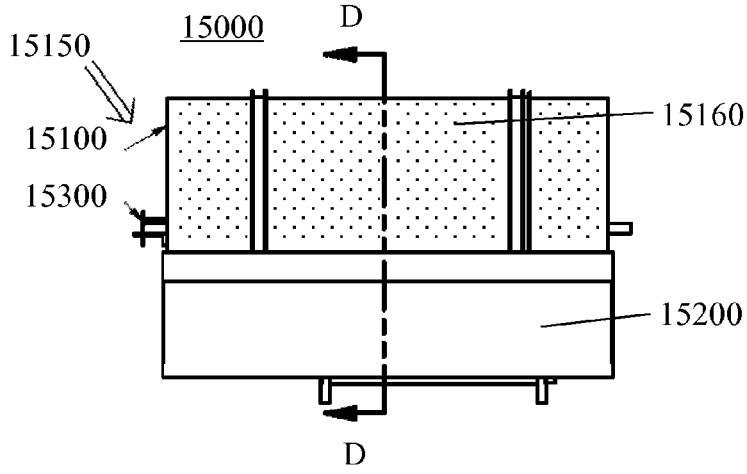
Figure 17:
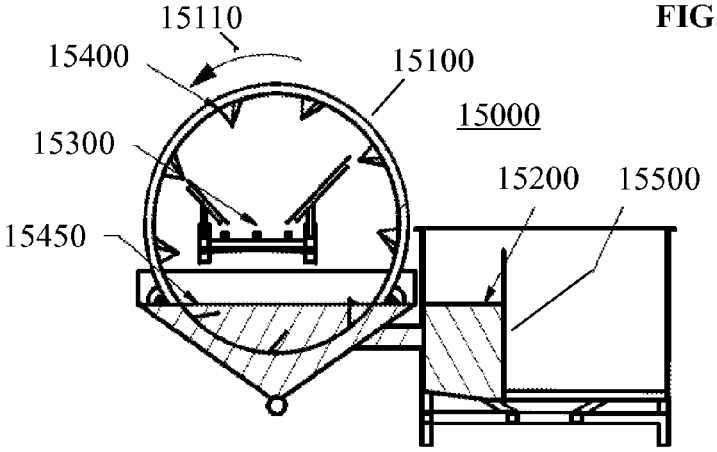
Figure 18:
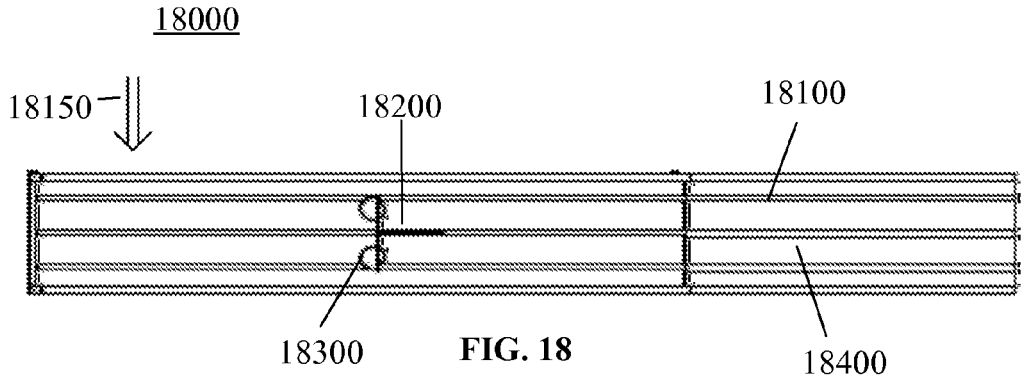
Figure 19:
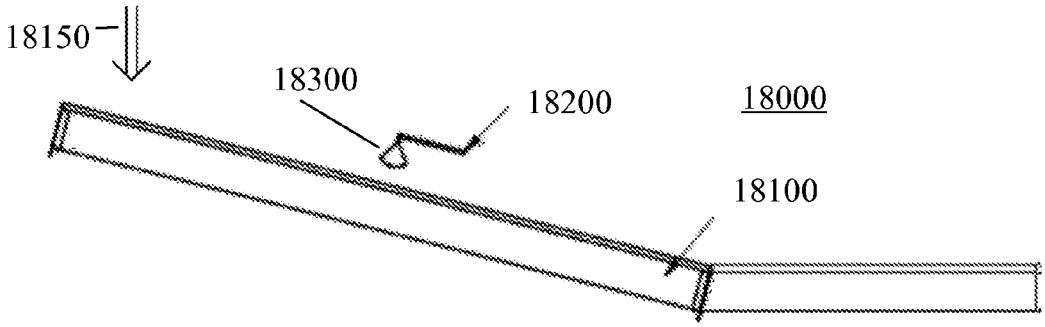
Figure 20:
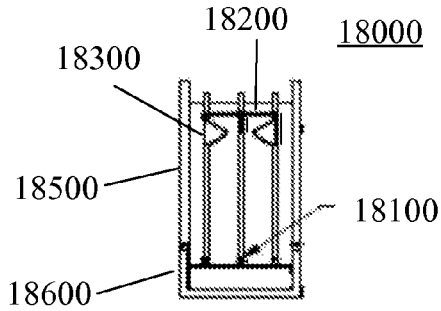
Figure 21:
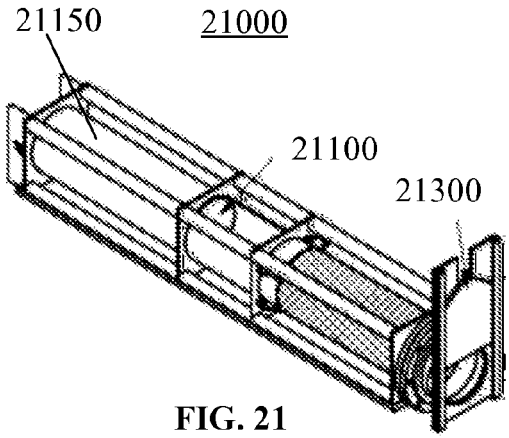
Figure 22:
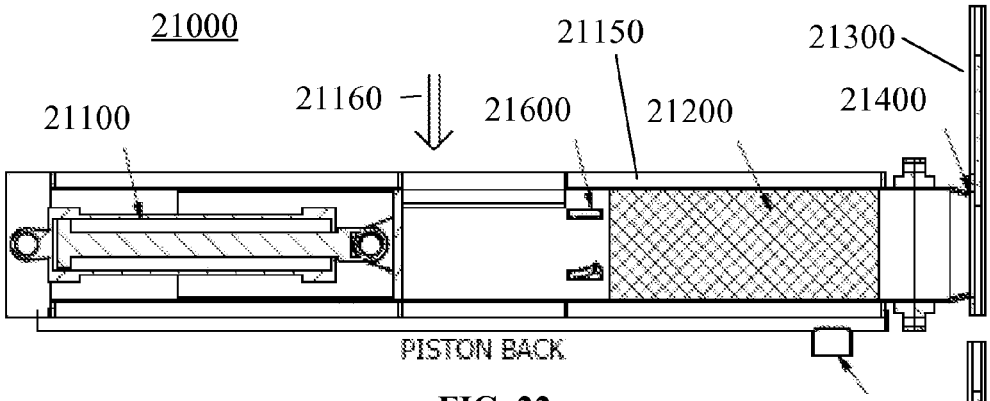
Figure 23:
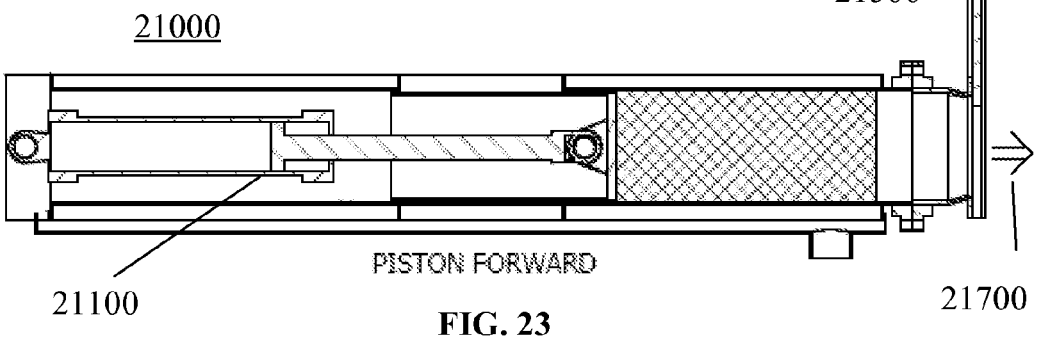

C-C;

FIG. 15 is a perspective view of an exemplary embodiment of a system 15000;

FIG. 16 is a side view of an exemplary embodiment of a system 15000;

FIG. 17 is a cross-sectional view of FIG. 16 taken along section D-D;

FIG. 18 is a top view of an exemplary embodiment of a system 18000;

FIG. 19 is a side view of an exemplary embodiment of a system 18000;

FIG. 20 is an end view of an exemplary embodiment of a system 18000;

FIG. 21 is a perspective view of an exemplary embodiment of a system 21000;

FIG. 22 is a side view of an exemplary embodiment of a system 21000; and FIG. 23 is a side view of an exemplary embodiment of a system 21000.

DETAILED DESCRIPTION

Certain exemplary embodiments can provide a system, machine, and/or device adapted for washing and drying a product via a continuous forward flow of product and a reverse flow of aqueous content. Certain exemplary embodiments can provide an auger, a rotating paddle wheel, a perforated spiral drum, a perforated cylindrical drum, and/or a hydraulic ram press.

Figure 1:
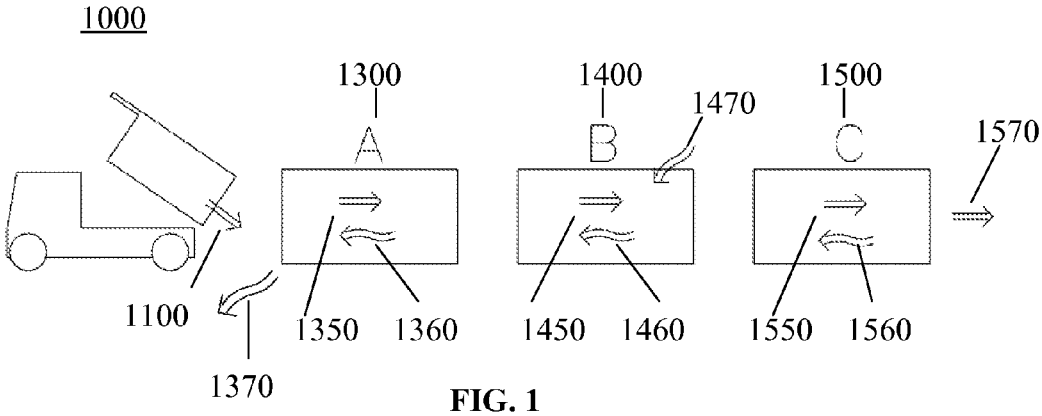
FIG. 1 is a block diagram of an exemplary embodiment of a system 1000.

FIG. 1 is a block diagram of an exemplary embodiment of a system 1000. Product 1100 can enter stage A. Product 1100 can flow in a direction 1350 through device 1300. Aqueous content 1360 can flow in an opposite direction through device 1300. Product 1100 can be submerged and/or washed via aqueous content flow 1360 in device 1300. Excess aqueous content 1370 can exit device 1300. Product 1100 can pass to stage B. Product 1100 can flow in a direction 1450 through device 1400. Aqueous content 1460 can flow in an opposite direction through device 1400 and into device 1300. Product 1100 can be separated and moved out of device 1400. Additional aqueous content 1470 can flow into device 1400. Product 1100 can pass to stage C. Product 1100 can flow in a direction 1550 through device 1500. Aqueous content 1560 can flow in an opposite direction through device 1500 and/or into device 1400. Product 1100 can be separated from aqueous content 1560. Substantially dried product 1570 can exit device 1500.

Figure 2:
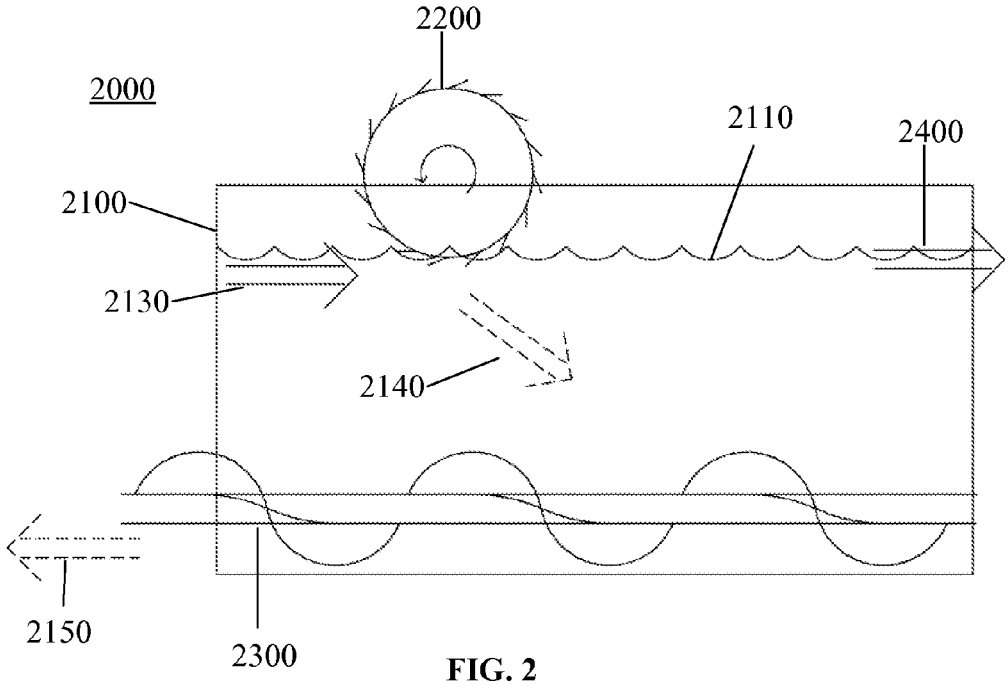
FIG. 2 is a block diagram of an exemplary embodiment of a system 2000.

FIG. 2 is a block diagram of an exemplary embodiment of a system 2000, which can comprise tank 2100, paddle 2200, and/or auger 2300. Aqueous content 2110 can be contained by tank 2100. Product 2130 can flow through aqueous content 2110 and/or can be submerged by paddle 2200. Foreign material 2140 can sink in aqueous content 2110 and/or can be removed by auger 2300 via exit 2150. Substantially cleaned product 2400 then can exit tank 2100.

Figure 3:
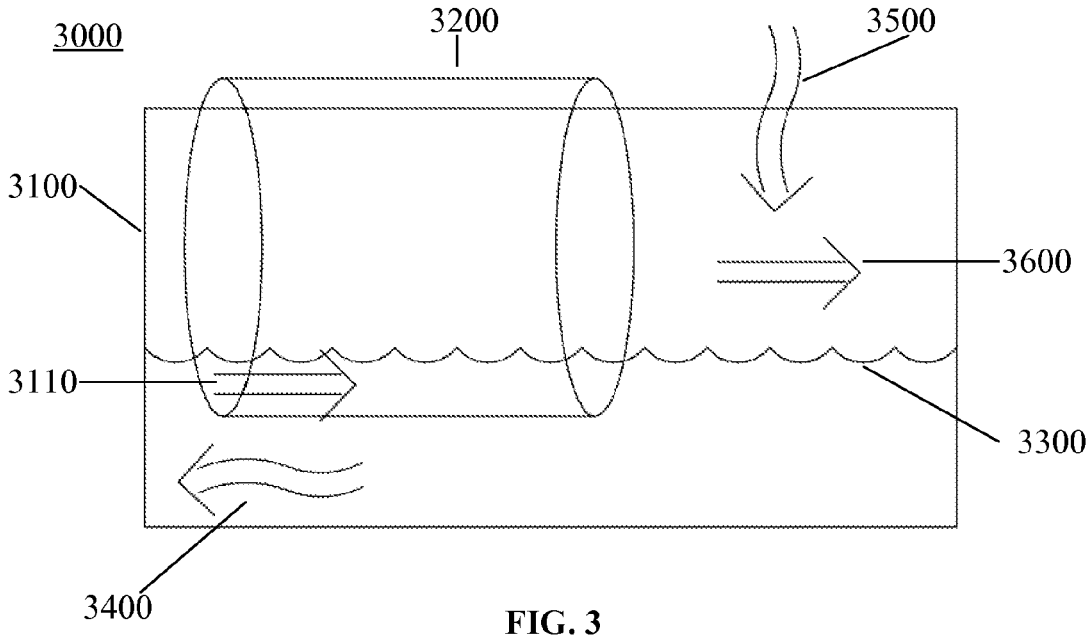
FIG. 3 is a block diagram of an exemplary embodiment of a system 3000.

FIG. 3 is a block diagram of an exemplary embodiment of a system 3000, which can comprise tank 3100 and rotating drum 3200. Product 3110 can enter rotating drum 3200. Aqueous content 3300 can be contained in tank 3100. A portion 3400 of aqueous content 3300 can exit tank 3100. Additional aqueous content 3500 can enter tank 3100. Separated product 3600 then can exit tank 3100.

Figure 4:
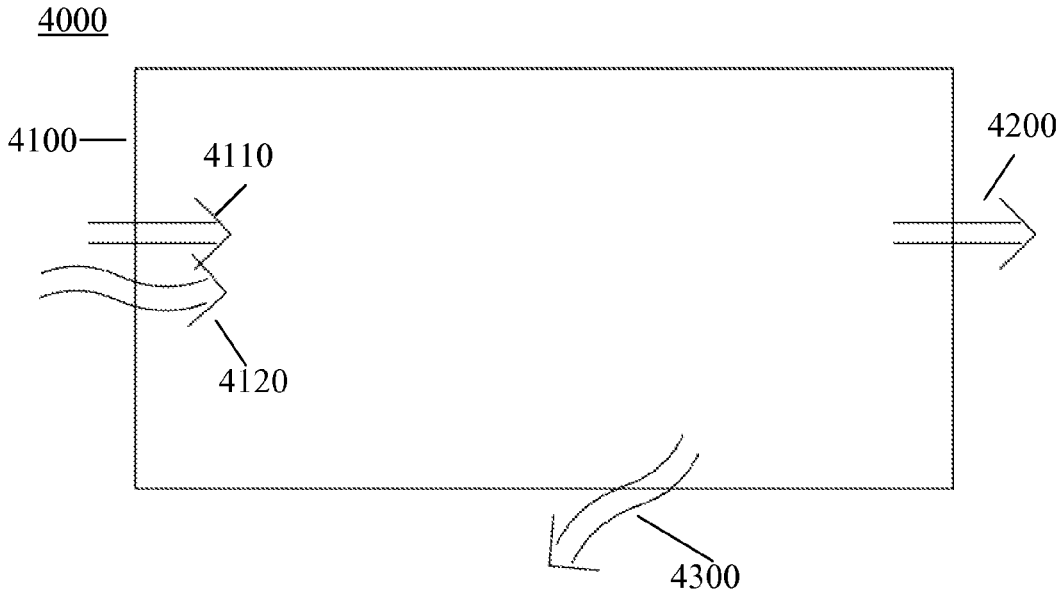
FIG. 4 is a block diagram of an exemplary embodiment of a system 4000.

FIG. 4 is a block diagram of an exemplary embodiment of a system 4000, which can comprise tank 4100. Product 4110 and aqueous content 4120 can enter. Substantially dried product 4200 can exit tank 4100 and aqueous content 4300 can exit tank 4100.

Figure 5:
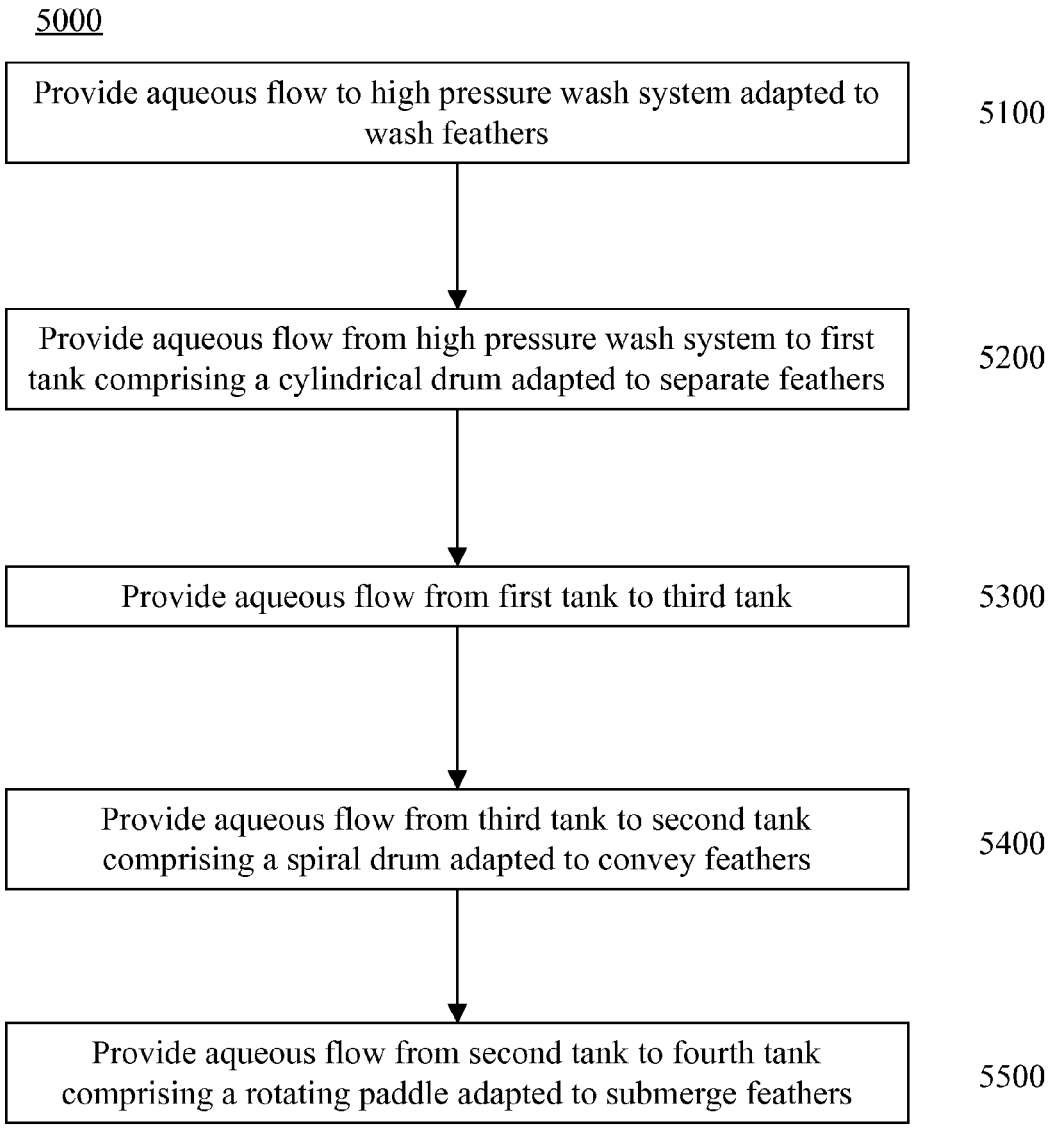
FIG. 5 is a flowchart of an exemplary embodiment of method 5000.

FIG. 5 is a flowchart of an exemplary embodiment of a method 5000. At activity 5100, aqueous flow can be provided to a high pressure wash system adapted to wash feathers. At activity 5200, aqueous flow can be provided from the high pressure wash system to a first tank comprising a cylindrical drum adapted to separate feathers. At activity 5300, aqueous flow can be provided from the first tank to a third tank. At activity 5400, aqueous flow can be provided from the third tank to a second tank comprising a spiral drum adapted to convey feathers. At activity 5500, aqueous flow can be provided from the second tank to a fourth tank comprising a rotating paddle adapted to submerge feathers.

Figure 6:
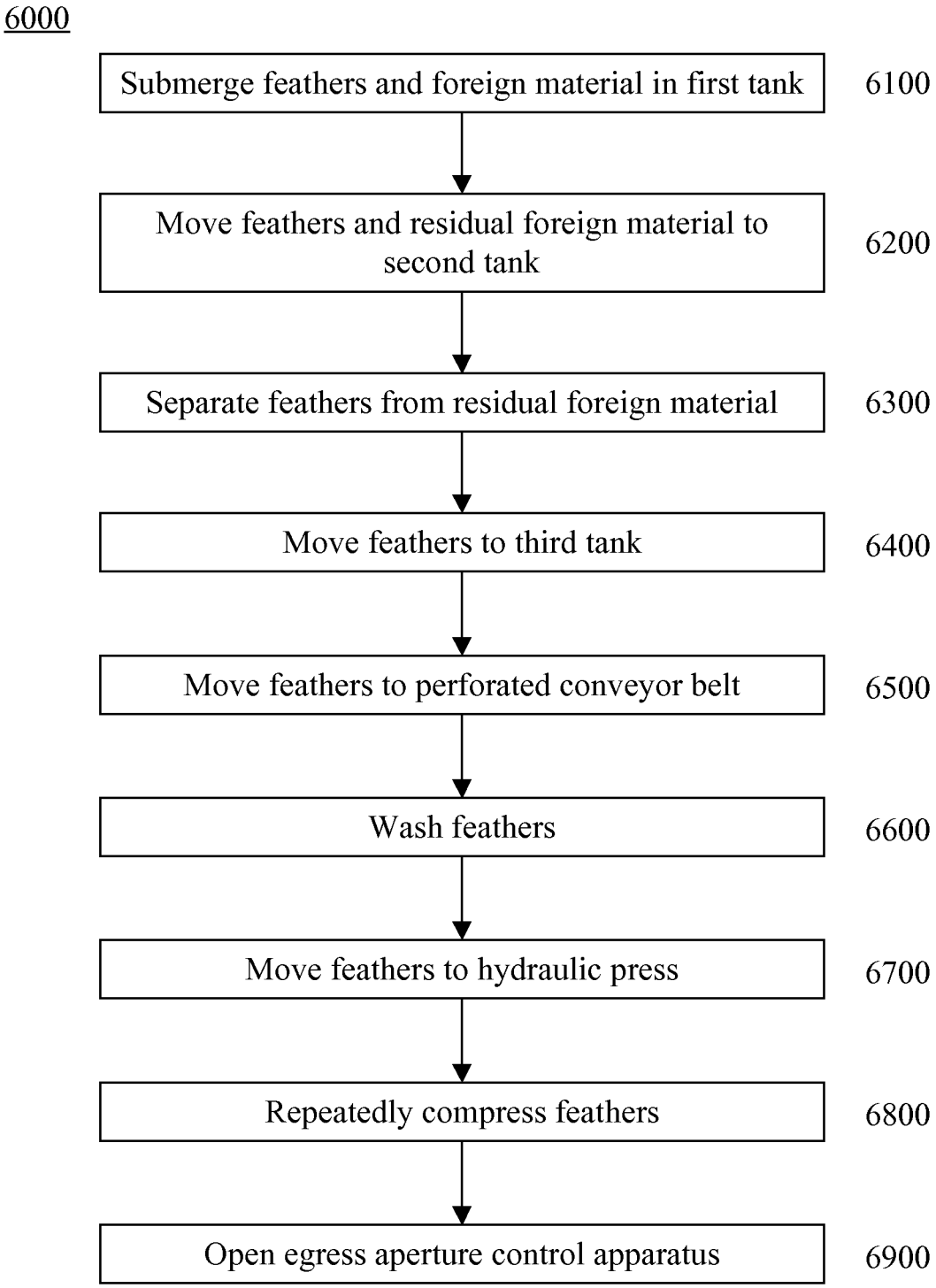
FIG. 6 is a flowchart of an exemplary embodiment of method 6000.

FIG. 6 is a flowchart of an exemplary embodiment of a method 6000. At activity 6100, feathers and foreign material can be submerged in a first tank. At activity 6200, feathers and a residual portion of foreign material can be moved to a second tank. At activity 6300, the feathers and residual foreign material can be separated. At activity 6400, the feathers can be moved to a third tank. At activity 6500, the feathers can be moved to a perforated conveyor belt. At activity 6600, the feathers can be washed. At activity 6700, the feathers can be moved to a hydraulic press. At activity 6800, the feathers can be repeatedly compressed. At activity 6900, an egress aperture control apparatus can be opened.

Figure 7:
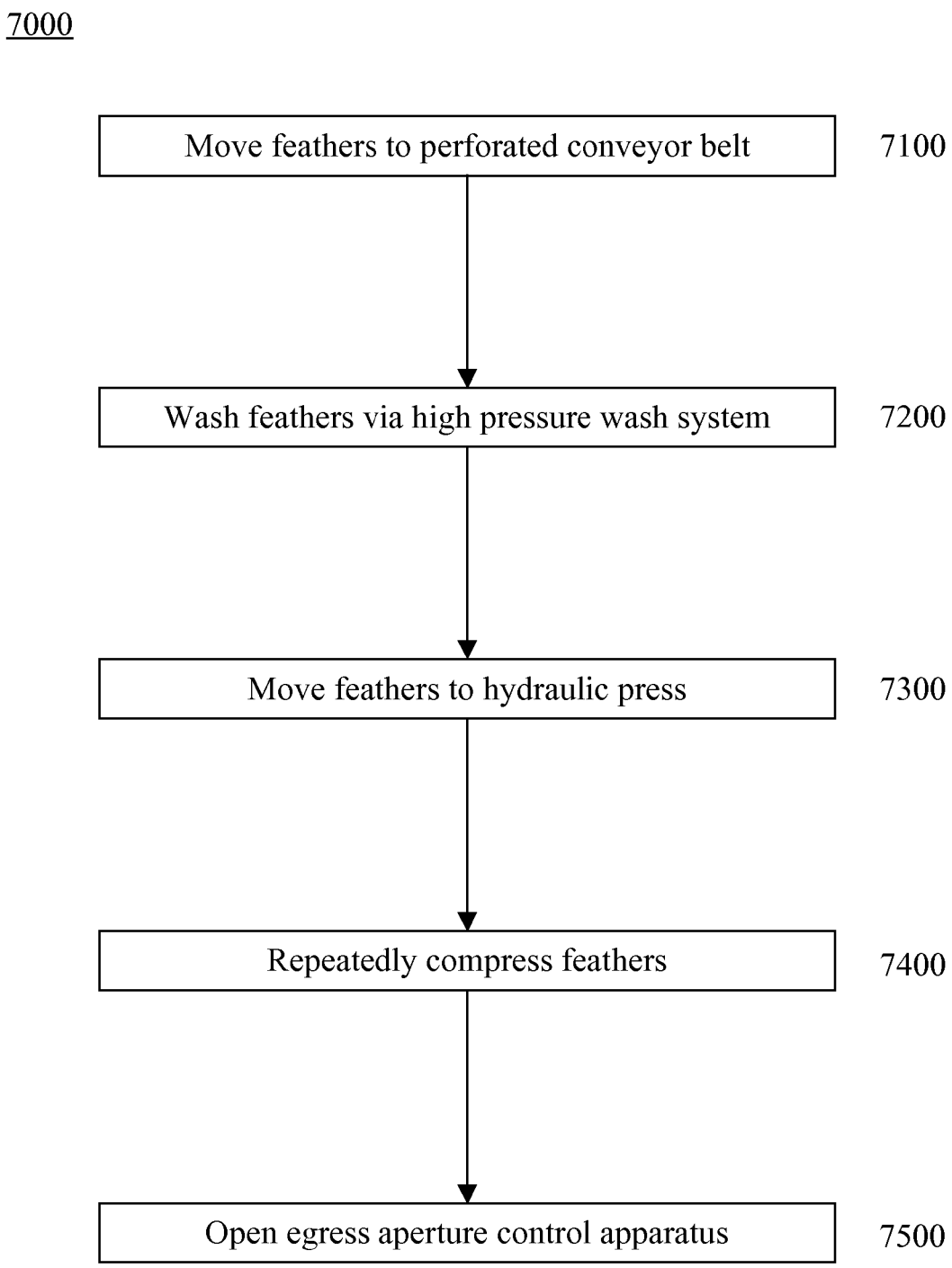
FIG. 7 is a flowchart of an exemplary embodiment of method 7000.

FIG. 7 is a flowchart of an exemplary embodiment of a method 7000. At activity 7100, the feathers can be moved to a perforated conveyor belt. At activity 7200, the feathers can be washed via a high pressure wash system. At activity 7300, the feathers can be moved to a hydraulic press. At activity 7400, the feathers can be repeatedly compressed. At activity 7500, an egress aperture control apparatus can be opened.

Figure 8:
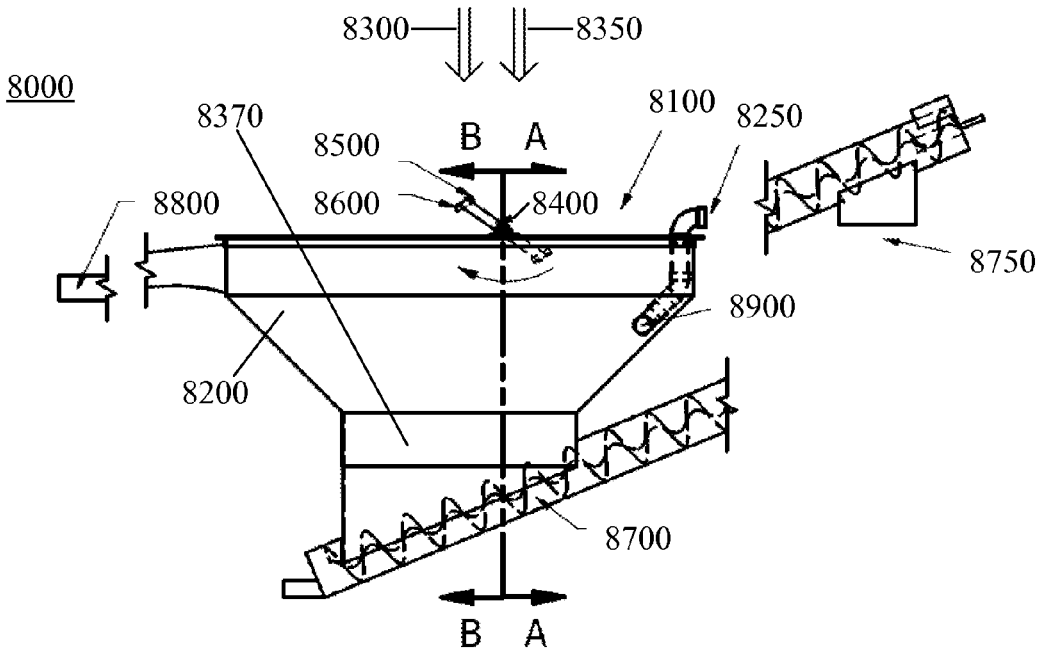
FIG. 8 is a side view of an exemplary embodiment of a system 8000.

FIG. 8 is a side view of an exemplary embodiment of a system 8000. Aqueous content 8200 can be pumped into tank 8100 via pipe 8250. Aqueous content 8200 can be charged to a pH greater than 7, such as from a pH of approximately 9 to approximately 12, by the addition of an alkaline substance, such as caustic, e.g., sodium hydroxide, potassium hydroxide, magnesium hydroxide, and/or calcium oxide, etc. Certain exemplary embodiments can manually, semi-automatically, and/or automatically measure the pH of any aqueous content, such as aqueous content 8200, such as via, for example, pH strips, a hand-held pH tester, and/or an electronic pH monitor/transmitter communicatively coupled to a control system for system 8000. Certain exemplary embodiments can manually, semi-automatically, and/or automatically control the pH of any aqueous content, such as aqueous content 8200, such as via, for example, manual addition (or deferral of addition) of one or more chemicals, such as caustic and/or acid, manual activation of a chemical injector and/or pump, and/or automatic activation of a chemical injector and/or pump communicatively coupled to a control system for system 8000. Certain exemplary embodiments can manually, semi-automatically, and/or automatically monitor and/or control one or more other appropriate process parameters, such as level, temperature, salinity, and/or dissolved solids, etc., of any aqueous content. For example, certain exemplary embodiments can manually, semi-automatically, and/or automatically monitor and/or control a level of aqueous content 8200 via the vertical placement of the outlet 8800 (see FIG. 10) on tank 8100 and/or the amount of aqueous content 11150 (see FIG. 12) in system 11000 via a float operated valve in fluid communication with drain 11600 (see FIG. 12). Feathers 8300 and/or foreign material 8350 can be moved into tank 8100. Rotating paddle 8400 can submerge and break up combinations of feathers 8300 and/or foreign material 8350 floating in aqueous content 8200. Leading edge 8500 of rotating paddle 8400 can be adjusted such that upon rotation leading edge 8500 of rotating paddle 8400 remains above the level of aqueous content 8200. Trailing edge 8600 of rotating paddle 8400 can be adjusted such that upon rotation trailing edge 8600 of rotating paddle 8400 remains below the level of aqueous content 8200. Sinking debris 8370, which can comprise primarily foreign material 8350, potentially in combination with a relatively small proportion of feathers 8300, can be removed from tank 8100 by rotating auger 8700. This function also can be accomplished by a conveyor belt, a bucket conveyer, a chain conveyor, a hydrocyclone, a roller pump, a sump pump, a gear pump, a centrifugal pump, and/or a jet pump. A portion 8750 of rotating auger 8700 can extend above the top of tank 8100. A portion of aqueous content 8200, feathers 8300, and/or a residual portion of foreign material 8350 can exit tank 8100 via outlet 8800.

Figure 9:
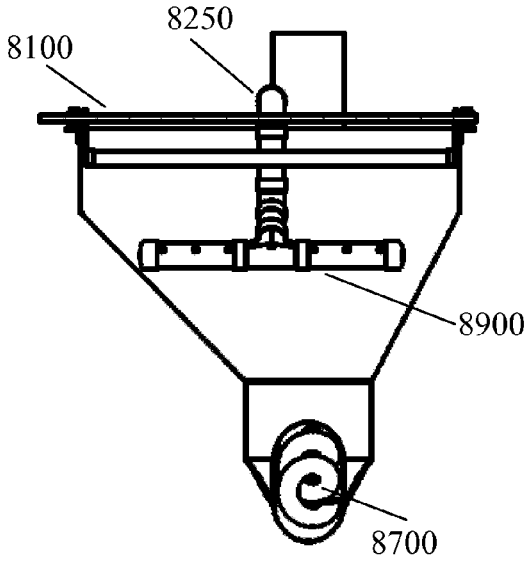
FIG. 9 is a cross-sectional view of FIG. 8 taken along section A-A in the direction indicated.

FIG. 9 is a cross-sectional view of device 8000 in FIG. 8 taken along section A-A in the direction indicated. Pipe 8250 can be connected to manifold 8900. Manifold 8900 can direct aqueous flow along the surface of aqueous content 8200 towards outlet 8800. In certain exemplary embodiments, the aqueous content can range from approximately 100 to approximately 500 gallons per minute.

Figure 10:
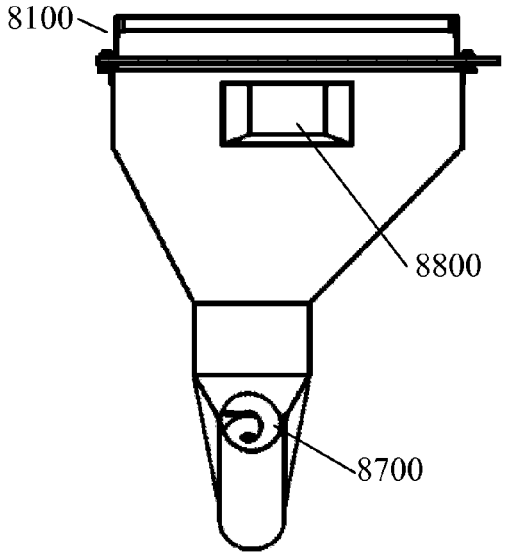
FIG. 10 is a cross-sectional view of FIG. 8 taken along section B-B in the direction indicated.

FIG. 10 is a cross-sectional view of device 8000 in FIG. 8 taken along section B-B in the direction indicated. Outlet 8800 can be positioned at the opposite end of tank 8100 from manifold 8900.

Figure 11:
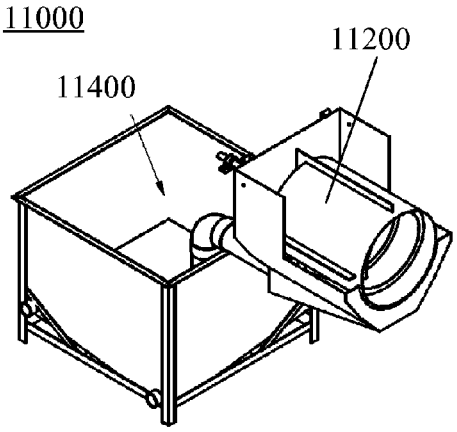
FIG. 11 is a perspective view of an exemplary embodiment of a system 11000.

FIG. 11 is a perspective view of an exemplary embodiment of a system 11000, which can be used to substantially dry feathers, and/or which can comprise a rotating perforated spiral drum 11200 and/or a holding tank 11400.

Figure 12:
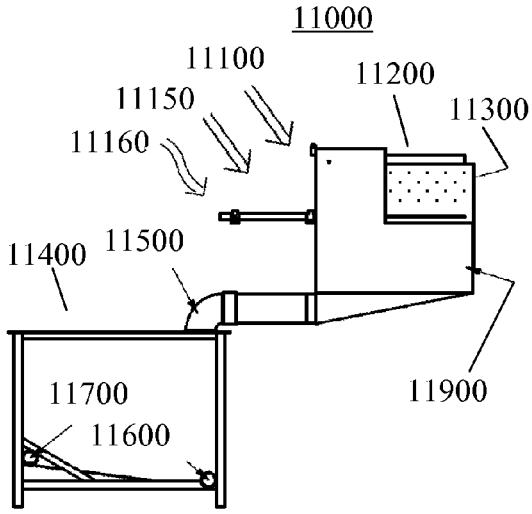
FIG. 12 is a side view of an exemplary embodiment of a system 11000.

FIG. 12 is a side view of an exemplary embodiment of system 11000. Feathers 11100, aqueous content 11150, and/or a residual portion of foreign material 11160 can enter spiral drum 11200 from outlet 8800 (shown in FIG. 10). Spiral drum 11200 can comprise perforations 11300. Perforations 11300 can have an average maximum dimension of less than approximately 0.15 inches, such as 0.125 inches, 0.010 inches, 0.0875 inches, etc., and/or be spaced such that the perforations occupy approximately 10% to approximately 50% of the surface of spiral drum 1120. For example, perforations 11300 can be centered approximately 0.1875 inches, 0.20 inches, 0.25 inches, etc., apart. Aqueous content 11150 and/or foreign material 11160 smaller than perforations 11300 can drop out of spiral drum 11200 into holding tank 11400 via tube 11500. Spiral drum 11200 can have open end 11900. Aqueous content 11150 can be pumped via outlet 11700 to pipe 8250 in tank 8100 (shown in FIG. 8). Excess aqueous content in tank 11400 can be discarded via drain 11600.

Figure 13:
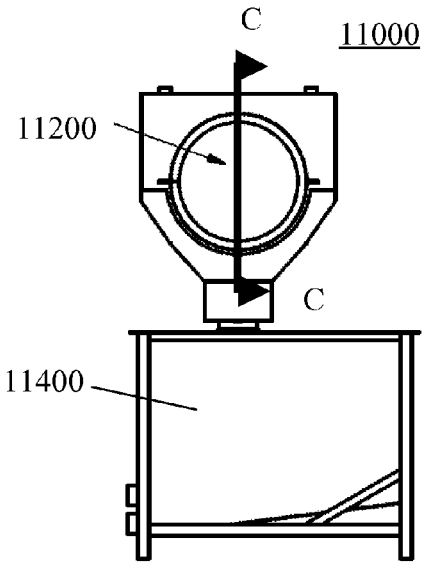
FIG. 13 is an end view of an exemplary embodiment of a system 11000.

FIG. 13 is an end view of an exemplary embodiment of system 11000.

Figure 14:
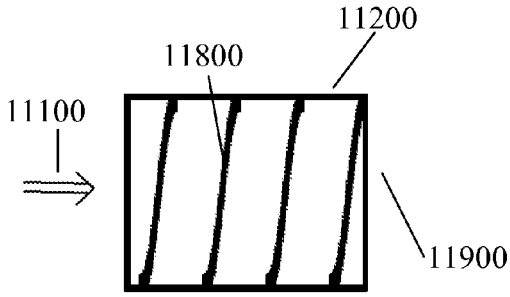
FIG. 14 is a cross-sectional view of 11200 of FIG. 13 taken along section

FIG. 14 is a cross-sectional view of spiral drum 11200 of FIG. 13 along C-C. Spiral drum 11200 can have flighting 11800. Feathers 11100 remaining in perforated spiral drum 11200 can be moved to open end 11900 of spiral drum 11200 by substantially continuous helical flighting 11800, and exit spiral drum 11200 through open end 11900, which can also be accomplished by a linear conveyor, a rotating conical drum, an angled cylindrical drum, and/or a tilting cylindrical drum. Flighting 11800 can have a pitch of approximately 4 inches to approximately 16 inches, and/or 10% to approximately 40% of drum length (e.g., approximately 12%, 15.2%, 20%, 26%, 30%, 36.75%, etc., of drum length) assuming the diameter of the drum is approximately 80% of drum length. Flighting depth can range from approximately 0.75 inches to approximately 5 inches, and/or from 4% to approximately 20% of drum diameter (e.g., approximately 5%, 6.25%, 9.5%, 14%, 17.75%, etc., of drum diameter).

FIG. 15 is a perspective view of an exemplary embodiment of a system 15000, which can separate aqueous content from feathers and/or which can comprise a rotating perforated cylindrical drum 15100, a tank 15200, and/or a perforated conveyor belt 15300.

FIG. 16 is a side view of an exemplary embodiment of system 15000. Feathers 15150 can enter tank 15200 after exiting open end 11900 of spiral drum 11200 (shown in FIG. 11). Rotating perforated cylindrical drum 15100 can be positioned above tank 15200. Perforated conveyor belt 15300 can pass through perforated cylindrical drum 15100. Cylindrical drum 15100 can have perforations 15160. Perforations 15160 can have an average maximum dimension of less than approximately 0.15 inches, such as 0.125 inches, 0.010 inches, 0.0875 inches, etc., and/or be spaced such that the perforations occupy approximately 10% to approximately 50% of the surface of spiral drum 1120. For example, perforations 11300 can be centered approximately 0.1875 inches, 0.20 inches, 0.25 inches, etc., apart.

FIG. 17 is a cross-sectional view of FIG. 16 taken along section D-D. Cylindrical drum 15100 can rotate in the direction 15110. Cylindrical drum 15100 can comprise pickup paddles 15400. Pickup paddles 15400 can move feathers 15150 out of tank 15200 and onto perforated conveyor belt 15300. This function can also be accomplished by a bucket lift, an actuated sieve, a perforated scoop, and/or a skimming device. Aqueous content 15450 picked up with feathers 15150 by pickup paddles 15400 can exit cylindrical drum 15100 through perforations 15160. A level of aqueous content 15450 in tank 15200 can be controlled by baffle 15500. A level of aqueous content 15450 in tank 15200 alternatively can be controlled by an electrical pump and/or a hydraulic pump controlled by a limit switch. Excess aqueous content from tank 15200 can exit device 15000 and enter tank 11400 (shown in FIG. 11).

FIG. 18 is a top view of an exemplary embodiment of a system 18000, which can comprise a conveyor belt 18100 and/or a high pressure wash pump 18200. Feathers 18150 moved to conveyor belt 18100 via cylindrical drum 15100 (shown in FIG. 15) can be rinsed by aqueous content 18300 from high pressure wash pump 18200 while moving the length of conveyor belt 18100. This cleaning function alternatively can be accomplished by emersion washing of feathers 18150, steam-cleaning via a steam jet, and/or a counterflow of water on conveyor belt 18100. Conveyor belt 18100 can have openings 18400 to allow water to drain therefrom.

FIG. 19 is a side view of an exemplary embodiment of system 18000. Aqueous content 18300 provided by conveying device 18200 can substantially clean feathers 18150, pass through openings 18400 in conveyor belt 18100, and/or enter tank 15200 (shown in FIG. 15).

FIG. 20 is an end view of an exemplary embodiment of system 18000. Conveyor belt 18100 can have sloped portion 18500 and flat portion 18600.

FIG. 21 is a perspective view of an exemplary embodiment of a system 21000, which can comprise a hydraulic ram 21100, a cylinder 21150, and/or an egress control aperture 21300.

FIG. 22 is a side view of an exemplary embodiment of system 21000. Hydraulic ram 21100 can be retracted as shown. Feathers 21160 can be moved into cylinder 21150 and can be repeatedly compressed by hydraulic ram 21100, the function of which alternatively can be accomplished by an electrically actuated ram, a pneumatic ram, a gravity driven press, and/or flexible pneumatic press. Perforations 21200 in cylinder 21150 can allow aqueous content pressed from feathers 21160 to exit via nozzle 21500. Perforations 21200 can have an average dimension of approximately 0.32 inches, such as 0.25 inches, 0.15 inches, 0.125 inches, etc., and/or be spaced such that the perforations occupy approximately 5% to approximately 30% of the surface of cylinder 21150. For example, perforations 21200 can be centered approximately 0.5 inches, 0.45 inches, 0.4 inches, etc., apart. Exit taper 21400 of cylinder 21150 can reduce the diameter of cylinder 21150 by approximately 5% to approximately 40%. Egress control aperture 21300 can remain closed until a pressure measurement of feathers 21160 under compression by hydraulic ram 21100 reaches a predetermined level. Cleats 21600 can prevent feathers 21160 from retracting upon the reciprocation of hydraulic ram 21100. Aqueous content 21550 exiting via nozzle 21500 can be conveyed to tank 15200 (shown in FIG. 15).

FIG. 23 is a side view of an exemplary embodiment of system 21000 with hydraulic ram 21100 extended. Egress control aperture 21300 can open and allow the exit 21700 of substantially dry feathers 21160.

Certain exemplary embodiments can provide a system, machine, device, manufacture, circuit, composition of matter, and/or user interface adapted for and/or resulting from, and/or a method and/or machine-readable medium comprising machine-implementable instructions for, activities that can comprise and/or relate to:

washing a plurality of feathers on a perforated conveyor belt via a high pressure wash system, the plurality of feathers moved from a first tank to the perforated conveyor belt via a perforated rotating drum comprising pickup paddles partially submerged in the first tank, a first aqueous flow provided to the first tank from the high pressure wash system, the first aqueous flow a portion of a second aqueous flow, the second aqueous flow provided to the high pressure wash system, the feathers moved to the first tank via a rotating perforated spiral drum adapted to separate the feathers from a residual portion of a plurality of foreign material, the perforated spiral drum positioned above a second tank, a third aqueous flow provided to the second tank from a third tank, the third aqueous flow a portion of the first aqueous flow, the plurality of feathers, the residual portion of the plurality of foreign material, and a fourth aqueous flow moved to the spiral drum via an inclined flume from a fourth tank, the fourth aqueous flow a portion of a fifth aqueous flow, the fifth aqueous flow provided to the fourth tank from the second tank, the fourth tank comprising a rotating paddle wheel adapted to submerge the plurality of feathers and the plurality of foreign material;

via a hydraulic ram press, pressing a plurality of feathers to achieve a predetermined moisture level, the hydraulic ram press adapted to repeatedly compress the plurality of feathers, the hydraulic press comprising a perforated perimeter wall and an egress aperture control apparatus, the moisture level controlled, at least in part, by an aperture size of the egress aperture control apparatus, the egress aperture control apparatus adapted to open responsive to an indication that a pressure measurement of the plurality of feathers while located in the hydraulic ram press is greater than a predetermined threshold, the plurality of feathers moved to the hydraulic press via a perforated conveyor belt, the plurality of feathers on the perforated conveyor belt washed via a high pressure wash system, the plurality of feathers moved to the perforated conveyor belt via a rotating drum comprising pickup paddles partially submerged in a tank containing an aqueous content, a first aqueous flow pressed out of the plurality of feathers provided to the tank, a second aqueous flow from the high pressure wash system provided to the tank;

moving a combination of a plurality of feathers and a plurality of foreign material into a first tank, the first tank containing a cleansing agent, a first aqueous flow provided to the first tank from a second tank;

via a rotating paddle wheel located in the first tank, submersing the plurality of feathers and the plurality of foreign material;

moving a first discarded portion of the plurality of foreign material out of the first tank via a rotating auger and moving a portion of the first aqueous flow out of the first tank;

moving a combination of the plurality of feathers, a first residual portion of the plurality of foreign material, and a second aqueous flow from the first tank into a perforated spiral drum via an inclined flume, the second aqueous flow a portion of the first aqueous flow, a third aqueous flow provided to the second tank from a fourth tank, the third aqueous flow a portion of a fourth aqueous flow;

in the second tank, skimming a plurality of floating material via a skimming device;

separating the plurality of feathers from the first residual portion of the plurality of foreign material via the perforated spiral drum, the spiral drum adapted to convey the plurality of feathers to a third tank, the fourth aqueous flow provided to the third tank from a fresh water high pressure wash system, the fourth aqueous flow a portion of a fifth aqueous flow, a content level in the third tank regulated by a baffle located in a sixth aqueous flow, the sixth aqueous flow between the third tank and the fourth tank;

moving the plurality of feathers from the third tank to a perforated conveyor belt via a partially submerged perforated rotating drum, the drum comprising pick up paddles;

washing the plurality of feathers on the perforated conveyor belt via the fresh water high pressure wash system, the fifth aqueous flow provided to the fresh water high pressure wash system;

moving the plurality of feathers via the perforated conveyor belt into a hydraulic ram press comprising a perforated perimeter wall and an egress aperture control apparatus;

responsive to an indication that a pressure measurement of the plurality of feathers while located in the hydraulic ram press is greater than a predetermined threshold, adjusting the egress aperture control apparatus; and via the hydraulic ram press, pressing the plurality of feathers to achieve a predetermined moisture level, the moisture level determined, at least in part, by an aperture size of the egress aperture control apparatus;

moving a discarded portion of the foreign material out of the fourth tank via a rotating auger;

skimming floating material from a surface of an aqueous content of the second tank via a skimming device;

discarding an excess portion of an aqueous content of the second tank;

moving the plurality of feathers from the high pressure wash system via the perforated conveyor belt into a hydraulic ram press comprising a perforated perimeter wall and an egress aperture control apparatus;

moving the plurality of feather via the perforated conveyor belt into a hydraulic ram press comprising a perforated perimeter wall and an egress aperture control apparatus, wherein the limiting apparatus comprises a taper and a sliding door;

moving the plurality of feathers via the perforated conveyor belt into a hydraulic ram press comprising a perforated perimeter wall and an egress aperture control apparatus, wherein the perforated perimeter wall comprises a plurality of perforations, an average maximum dimension of the plurality of perforations less than approximately 0.32 inches;

moving the plurality of feathers via the perforated conveyor belt into a hydraulic ram press comprising a perforated perimeter wall and an egress aperture control apparatus, the egress aperture control apparatus adapted to open responsive to an indication that a pressure measurement of the plurality of feathers while located in the hydraulic ram press is greater than a predetermined threshold;

moving the plurality of feathers via the perforated conveyor belt into a hydraulic ram press comprising a perforated perimeter wall and an egress aperture control apparatus, the egress aperture control apparatus adapted to open responsive to an indication that a pressure measurement of the plurality of feathers while located in the hydraulic ram press is greater than approximately 800 psig;

moving the plurality of feathers via the perforated conveyor belt into a hydraulic ram press comprising a perforated perimeter wall and an egress aperture control apparatus, the egress aperture control apparatus adapted to open responsive to an indication that a pressure measurement of the plurality of feathers while located in the hydraulic ram press is greater than a predetermined threshold, the hydraulic press adapted to press the plurality of feathers to achieve a predetermined moisture level, the moisture level controlled, at least in part, by an aperture size of the egress aperture control apparatus;

moving the plurality of feathers via the perforated conveyor belt into a hydraulic ram press comprising a perforated perimeter wall and an egress aperture control apparatus, the egress aperture control apparatus adapted to open responsive to an indication that a pressure measurement of the plurality of feathers while located in the hydraulic ram press is greater than a predetermined threshold, the hydraulic press adapted to press the plurality of feathers to achieve a predetermined moisture level, the moisture level controlled, at least in part, by an aperture size of the egress aperture control apparatus, a diameter of the aperture size of the egress aperture control apparatus equal to approximately 60% to approximately 95% of the diameter of the hydraulic ram;

moving the plurality of feathers via the perforated conveyor belt into a hydraulic ram press comprising a perforated perimeter wall and an egress aperture control apparatus, the egress aperture control apparatus adapted to open responsive to an indication that a pressure measurement of the plurality of feathers while located in the hydraulic ram press is greater than a predetermined threshold, the hydraulic press adapted to press the plurality of feathers to achieve a predetermined moisture level, the moisture level controlled, at least in part, by an aperture size of the egress aperture control apparatus, a sixth aqueous flow pressed out of the plurality of feathers provided to the first tank; and/or moving the plurality of feathers via the perforated conveyor belt into a hydraulic ram press comprising a perforated perimeter wall and a limiting apparatus, the hydraulic ram press adapted to repeatedly compress the plurality of feathers;

wherein:

the fifth aqueous flow comprises a cleansing agent;

the fifth aqueous flow comprises caustic soda;

a pH level of the fifth aqueous flow is maintained, via the addition of a cleansing agent, between approximately 9 and approximately 12;

the perforated spiral drum is adapted to retain the plurality of feathers and to discard the residual portion of the foreign material into the second tank; and/or a content level in the first tank is regulated by a baffle located in a sixth aqueous flow, the sixth aqueous flow between the first tank and the third tank.

DEFINITIONS

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.
above—at a higher level.
achieve—to attain with effort.
adapted to—configured to and/or made suitable and/or fit to facilitate a specific use and/or situation.
addition—an act of adding one thing to another.
adjusting—the act of changing so as to match, fit, adapt, conform, and/or be in a more effective state.
an—at least one.
and—in conjunction with.
and/or—either in conjunction with or in alternative to.
aperture—an opening, hole, gap, passage, and/or slit.
apparatus—an appliance and/or device for a particular purpose.
approximately—about and/or nearly the same as.
aqueous—related to, produced by, similar to, containing, and/or dissolved in water.
at—in, on, and/or near.
at least—not less than.
auger—a rotating helical shaft used to convey material.
average—a value obtained by dividing the sum of a set of quantities by the number of quantities in a set and/or an approximation of a statistical expected value.
baffle—a usually static, but potentially movable, device that regulates the flow of a fluid.
between—in a separating interval and/or intermediate to.
by—via and/or with the use or help of.
can—is capable of, in at least some embodiments.
caustic soda—sodium hydroxide, also known as lye.
cleansing agent—a chemical that helps remove unwanted foreign material.
combination—a union of separate parts.
compress—to decrease in volume by the application of pressure.
comprises—includes, but is not limited to, what follows.
containing—to hold within its volume and/or area.
content—all that is contained and/or held within a volume and/or area.
control—a mechanical or electronic device used to operate a machine within predetermined limits;
controlled—restrained, managed, and/or kept within certain bounds.
convey—to transmit, transport, guide, and/or carry.
conveyor belt—a mechanical apparatus comprising a continuous moving belt-like device adapted to transport materials from one place to another.
determined—found and/or decided upon.
device—a machine, manufacture, and/or collection thereof that is typically adapted to a particular purpose.
diameter—a length of a straight line segment passing through a center of an object and terminating at the periphery thereof.
dimension—an extension in a given direction and/or a measurement in length, width, or thickness.
discard—to throw away and/or reject.
discarded—thrown away and/or rejected.
discarding—the act of throwing away and/or rejecting.
door—a movable solid barrier for opening and closing an aperture.
drum—a cylindrical object.
egress—a place, port, and/or device associated with exiting.
equal—substantially the same as.
excess—more than or above what is necessary, usual, and/or specified
feather—one of the horny structures forming the principal covering of birds, consisting typically of a hard, tubular portion attached to the body and tapering into a thinner, stemlike portion bearing a series of slender, barbed processes that interlock to form a flat structure on each side.
fifth—immediately following a fourth item in an ordering.
first—an initial entity in an ordering.
floating—being buoyed up on an aqueous substance.
flow—(n) a stream and/or current.
flume—a trough or channel for conducting an aqueous flow.
foreign material—material other than feathers.
fourth—immediately following a third thing in an ordering.
fresh—not contaminated and/or dirty.
from—used to indicate a source, origin, and/or location thereof.
further—in addition.
greater than—larger and/or more than.
having—including but not limited to.
hydraulic—operated by the pressure created by forcing a fluid through a comparatively narrow passage.
in part—partially.
inclined—at an angle with respect to a horizontal plane
indication—a sign or token.
into—toward, in the direction of, and/or to the inside of.
is—to exist in actuality.
less than—having a measurably smaller magnitude and/or degree as compared to something else.
level—a relative position on a scale and/or a position along a vertical axis indicating height and/or depth.
located—situated in a particular spot, region, and/or position.
maintained—retained, preserved, sustained, and/or kept in an existing state
material—a substance and/or composition.
maximum—a greatest extent.
may—is allowed and/or permitted to, in at least some embodiments.
measurement—a value of a variable, the value determined by manual and/or automatic observation.
method—a process, procedure, and/or collection of related activities for accomplishing something.
moisture—liquid diffused as vapor and/or condensed on or in objects.
moved—changed in position and/or place.
moving—transferring from one location to another.
open—not substantially obstructed.
out—away from and/or not in
paddle—a flat object for propelling and/or moving liquid and/or material
part—component.
partially—to an extent, but not necessarily totally.
perforated—pierced with, having, and/or presenting a hole or holes.
perforations—a series of holes through something.
perimeter—the outer limits or boundary of an area.
pH—a measure representing the base 10 logarithm of the reciprocal of hydrogen ion concentration in gram atoms per liter, used to express the acidity or alkalinity of a solution on a scale of 0 to 14, where less than 7 represents acidity, 7 neutrality, and more than 7 alkalinity.
pickup—designed for lifting and/or increasing the height of an object.
plurality—more than one.

portion—a part, component, section, percentage, ratio, and/or quantity that is less than a larger whole. Can be visually, physically, and/or virtually distinguishable and/or non-distinguishable.

positioned—to put in place and/or position.

predetermined—determined, decided, obtained, calculated, and/or established in advance.

predetermined threshold—a limit of an extent established in advance.

pressure—the exertion of force upon a surface by an object and/or fluid.

provide—to furnish, supply, give, and/or make available.

ram press—a device for exerting pressure via a piston.

receive—to get as a signal, take, acquire, and/or obtain.

regulated—controlled, directed, and/or adjusted according to a particular specification and/or requirement.

repeatedly—again and again, repetitively, and/or with consistent behavior.

residual—a remaining quantity.

responsive—reacting to an influence and/or impetus.

retain—to restrain, keep, and/or hold.

rotating—turning about an axis.

second—immediately following an initial item in an ordering.

separate—to disunite, space, set, or keep apart and/or to be positioned intermediate to.

sixth—immediately following a fifth item in an ordering.

size—physical dimensions, proportions, magnitude, amount, and/or extent of an entity.

skimming—taking up and/or removing from the surface of a liquid.

sliding—moving in a smooth and/or continuous motion.

helical—a path traversed by a point in or on a cylinder as that point moves around the cylinder while proceeding along the length of the cylinder.

submerge—to put and/or sink below the surface of a liquid.

substantially—to a great extent and/or degree.

surface—the outer boundary of an object and/or a material layer constituting and/or resembling such a boundary.

system—a collection of devices, machines, articles of manufacture, and/or processes, the collection designed to perform one or more practical, concrete, tangible, and useful functions.

tank—a container adapted to hold and/or store a solid and/or fluid.

taper—gradual diminution of a dimension in an elongated object.

third—immediately following a second item in an ordering.

threshold—a point, value, and/or limit that when exceeded produces a given effect and/or result.

to—a preposition adapted for use for expressing purpose.

transform—to change in measurable: form, appearance, nature, and/or character.

via—by way of, with, and/or utilizing.

wall—a partition, structure, and/or mass that serves to enclose, divide, separate, segregate, define, and/or protect a volume and/or to support a floor, ceiling, and/or another wall.

wash—to cleanse, using water or another liquid.

water—a transparent, odorless, tasteless liquid containing approximately 11.188 percent hydrogen and approximately 88.812 percent oxygen, by weight, characterized by the chemical formula $H_2O$, and, at standard pressure (approximately 14.7 psia), freezing at approximately 32° F. or 0 C and boiling at approximately 212° F. or 100 C.

wheel—a circular device arranged to revolve on an axis.

wherein—in regard to which; and; and/or in addition to.

while—for as long as, during the time that, and/or at the same time that.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

there is no requirement for the inclusion of any particular described characteristic, function, activity, substance, or structural element, for any particular sequence of activities, for any particular combination of substances, or for any particular interrelationship of elements;

no described characteristic, function, activity, substance, or structural element is "essential";

any two or more described substances can be mixed, combined, reacted, separated, and/or segregated;

any described characteristics, functions, activities, substances, and/or structural elements can be integrated, segregated, and/or duplicated;

any described activity can be repeated, any activity can be performed by multiple entities, and/or any activity can be performed in multiple jurisdictions; and any described characteristic, function, activity, substance, and/or structural element can be specifically excluded, the sequence of activities can vary, and/or the interrelationship of structural elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any phrase (i.e., one or more words) appearing in a claim is followed by a drawing element number, that drawing element number is exemplary and non-limiting on claim scope.

No claim of this document is intended to invoke paragraph six of 35 USC 112 unless the precise phrase "means for" is followed by a gerund.

Any information in any material (e.g., a United States patent, United States patent application, book, article, etc.) that has been incorporated by reference herein, is incorporated by reference herein in its entirety to its fullest enabling extent permitted by law yet only to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. A method comprising:

washing a plurality of feathers on a conveyor belt via a wash system, the plurality of feathers moved from a first tank to the conveyor belt via a rotating drum comprising pickup paddles partially submerged in the first tank, a first aqueous flow provided to the first tank from the wash system, the first aqueous flow a portion of a second aqueous flow, the second aqueous flow provided to the wash system, the feathers moved to the first tank via a spiral drum adapted to separate the feathers from a residual portion of a plurality of foreign material, a third aqueous flow provided to the second tank from a third tank, the third aqueous flow a portion of the first aqueous flow, the plurality of feathers, the residual portion of the plurality of foreign material, and a fourth aqueous flow moved to the spiral drum from a fourth tank, the fourth aqueous flow a portion of a fifth aqueous flow, the fifth aqueous flow provided to the fourth tank from the second tank.

2. The method of claim 1, wherein:

the fifth aqueous flow comprises a cleansing agent.

3. The method of claim 1, wherein:

the fifth aqueous flow comprises caustic soda.

4. The method of claim 1, wherein:

a pH level of the fifth aqueous flow is maintained, via the addition of a cleansing agent, between approximately 9 and approximately 12.

5. The method of claim 1, wherein:

the spiral drum is adapted to retain the plurality of feathers and to discard the residual portion of the foreign material into the second tank.

6. The method of claim 1, wherein:

a content level in the first tank is regulated by a baffle located in a sixth aqueous flow, the sixth aqueous flow between the first tank and the third tank.

7. The method of claim 1, further comprising:

moving a discarded portion of the foreign material out of the fourth tank via a rotating auger.

8. The method of claim 1, further comprising:

skimming floating material from a surface of an aqueous content of the second tank via a skimming device.

9. The method of claim 1, further comprising:

discarding an excess portion of an aqueous content of the second tank.

10. The method of claim 1, further comprising:

moving the plurality of feathers from the wash system into a ram press comprising a perforated perimeter wall and an egress aperture control apparatus.

11. The method of claim 1, further comprising:

moving the plurality of feather via the conveyor belt into a ram press comprising a perforated perimeter wall and an egress aperture control apparatus, wherein the limiting apparatus comprises a taper and a sliding door.

12. The method of claim 1, further comprising:

moving the plurality of feathers via the conveyor belt into a ram press comprising a perforated perimeter wall and an egress aperture control apparatus, wherein the perforated perimeter wall comprises a plurality of perforations, an average maximum dimension of the plurality of perforations less than approximately 0.32 inches.

13. The method of claim 1, further comprising:

moving the plurality of feathers via the conveyor belt into a ram press comprising a perforated perimeter wall and an egress aperture control apparatus, the egress aperture control apparatus adapted to open responsive to an indication that a pressure measurement of the plurality of feathers while located in the ram press is greater than a predetermined threshold.

14. The method of claim 1, further comprising:

moving the plurality of feathers via the conveyor belt into a ram press comprising a perforated perimeter wall and an egress aperture control apparatus, the egress aperture control apparatus adapted to open responsive to an indication that a pressure measurement of the plurality of feathers while located in the ram press is greater than approximately 800 psig.

15. The method of claim 1, further comprising:

moving the plurality of feathers via the conveyor belt into a ram press comprising a perforated perimeter wall and an egress aperture control apparatus, the egress aperture control apparatus adapted to open responsive to an indication that a pressure measurement of the plurality of feathers while located in the ram press is greater than a predetermined threshold, the ram press adapted to press the plurality of feathers to achieve a predetermined moisture level, the moisture level controlled, at least in part, by an aperture size of the egress aperture control apparatus.

16. The method of claim 1, further comprising:

moving the plurality of feathers via the conveyor belt into a ram press comprising a perforated perimeter wall and an egress aperture control apparatus, the egress aperture control apparatus adapted to open responsive to an indication that a pressure measurement of the plurality of feathers while located in the ram press is greater than a predetermined threshold, the ram press adapted to press the plurality of feathers to achieve a predetermined moisture level, the moisture level controlled, at least in part, by an aperture size of the egress aperture control apparatus, a diameter of the aperture size of the egress aperture control apparatus equal to approximately 60% to approximately 95% of the diameter of the ram press.

17. The method of claim 1, further comprising:

moving the plurality of feathers via the conveyor belt into a ram press comprising a perforated perimeter wall and an egress aperture control apparatus, the egress aperture control apparatus adapted to open responsive to an indication that a pressure measurement of the plurality of feathers while located in the ram press is greater than a predetermined threshold, the ram press adapted to press the plurality of feathers to achieve a predetermined moisture level, the moisture level controlled, at least in part, by an aperture size of the egress aperture control apparatus, a sixth aqueous flow pressed out of the plurality of feathers provided to the first tank.

18. The method of claim 1, further comprising:

moving the plurality of feathers via the conveyor belt into a ram press comprising a perforated perimeter wall and a limiting apparatus, the ram press adapted to repeatedly compress the plurality of feathers.

19. A method comprising:

via a ram press, pressing a plurality of feathers to achieve a predetermined moisture level, the ram press adapted to repeatedly compress the plurality of feathers, the ram press comprising a perforated perimeter wall and an egress aperture control apparatus, the moisture level controlled, at least in part, by an aperture size of the egress aperture control apparatus, the egress aperture control apparatus adapted to open responsive to an indication that a pressure measurement of the plurality of feathers while located in the ram press is greater than a predetermined threshold, the plurality of feathers moved to the ram press via a conveyor belt, the plurality of feathers on the conveyor belt washed via a wash system, the plurality of feathers moved to the conveyor belt via a rotating drum comprising pickup paddles partially submerged in a tank containing an aqueous content, a first aqueous flow pressed out of the plurality of feathers provided to the tank, a second aqueous flow from the wash system provided to the tank.

20. A method comprising:

moving a combination of a plurality of feathers and a plurality of foreign material into a first tank, the first tank containing a cleansing agent, a first aqueous flow provided to the first tank from a second tank;

via a rotating paddle wheel located in the first tank, submersing the plurality of feathers and the plurality of foreign material;

moving a first discarded portion of the plurality of foreign material out of the first tank via a rotating auger and moving a portion of the first aqueous flow out of the first tank;

moving a combination of the plurality of feathers, a first residual portion of the plurality of foreign material, and a second aqueous flow from the first tank into a spiral drum, the second aqueous flow a portion of the first aqueous flow, a third aqueous flow provided to the second tank from a fourth tank, the third aqueous flow a portion of a fourth aqueous flow;

in the second tank, skimming a plurality of floating material via a skimming device;

separating the plurality of feathers from the first residual portion of the plurality of foreign material via the spiral drum, the spiral drum adapted to convey the plurality of feathers to a third tank, the fourth aqueous flow provided to the third tank from a wash system, the fourth aqueous flow a portion of a fifth aqueous flow, a content level in the third tank regulated by a baffle located in a sixth aqueous flow, the sixth aqueous flow between the third tank and the fourth tank;

moving the plurality of feathers from the third tank to a conveyor belt via a rotating drum, the rotating drum comprising pick up paddles;

washing the plurality of feathers on the conveyor belt via the wash system, the fifth aqueous flow provided to the wash system;

moving the plurality of feathers via the conveyor belt into a ram press comprising a perforated perimeter wall and an egress aperture control apparatus;

responsive to an indication that a pressure measurement of the plurality of feathers while located in the ram press is greater than a predetermined threshold, adjusting the egress aperture control apparatus; and via the ram press, pressing the plurality of feathers to achieve a predetermined moisture level, the moisture level determined, at least in part, by an aperture size of the egress aperture control apparatus.

* * * * *